United States Patent [19]

Dawson

[11] 4,257,287

[45] Mar. 24, 1981

[54] BEVERAGE CAN OPENER

[76] Inventor: John C. Dawson, 3817-16th St., Des Moines, Iowa 50313

[21] Appl. No.: 54,854

[22] Filed: Jul. 5, 1979

[51] Int. Cl.[3] ..... B67B 7/40

[52] U.S. Cl. ..... 81/3.34; 30/298

[58] Field of Search ..... 81/3.46 R, 3.34, 3.36, 81/3.4, 3.46 A; 7/121; 30/296 R, 298; 294/26, 1 A; 145/61 C

[56] References Cited

U.S. PATENT DOCUMENTS

| | | | |
|---|---|---|---|
| 925,801 | 6/1909 | Callender | 7/121 |
| 1,867,713 | 7/1932 | Roberts | 30/298 |
| 2,106,639 | 1/1938 | Jenkinson | 81/3.46 R |
| 2,124,615 | 7/1938 | Foltz | 145/61 C |
| 3,459,075 | 8/1969 | Henderson | 81/3.34 |
| 3,460,411 | 8/1969 | Dyer | 81/3.34 |
| 3,724,297 | 4/1973 | Bucko | 294/26 |
| 4,133,228 | 1/1979 | De Pooter | 81/3.46 A |

*Primary Examiner*—Othell M. Simpson
*Assistant Examiner*—Roscoe V. Parker
*Attorney, Agent, or Firm*—Zarley, McKee, Thomte, Voorhees & Sease

[57] ABSTRACT

An opener apparatus for beverage cans having an opener tab provided on the top wall includes an elongated tool having a hook portion at the forward end and a handle portion at the rearward end. The hook portion extends forwardly from the handle portion a and then downwardly and rearwardly to define a channel adapted to receive the opener tab for lifting the tab and opening the can in response to lifting movement of the tool when a force is applied to the handle portion. A leg member may be extended downwardly from the tool and positioned for simultaneously depressing the scored section of the can top wall into the can and providing a fulcrum for lifting movement of the hook portion in response to downward movement of the handle portion.

4 Claims, 5 Drawing Figures

BEVERAGE CAN OPENER

BACKGROUND OF THE INVENTION

This invention relates generally to a tool for opening cans and more particularly to an improved tool for facilitating the opening of beverage cans having tab-type openers on the top walls thereof.

The provision of tab-type openers on the top walls of beverage cans is believed to have greatly contributed to the increased popularity of canned beer and soft drinks. To open such cans without assistance, however, is very difficult for many people. Some simply lack the strength to lift the opener tabs or find that the pressure required to be applied by their finger tip is unduly painful. The breakage of long fingernails is also a problem associated with opening the so called pop top openers.

Accordingly, it is a primary object of the present invention to provide an apparatus for facilitating the opening of beverage cans provided with an opener tab on the top wall thereof.

Another object is to provide a beverage can opener having a large gripping area to which force may be applied for opening a can.

A related object is to provide a beverage can opener which enables the application of a greater opening force to the opener tab.

Another object is to provide a beverage can opener which simultaneously urges the scored section of the can top wall into the can as the opener tab is lifted.

Finally, an object of the invention is to provide a beverage can opener which is simple in construction, economical to manufacture and durable and efficient in operation.

SUMMARY OF THE INVENTION

The beverage can opener of the present invention facilitates the opening of a beverage can provided with an opener tab on the top wall thereof. The beverage can opener is an elongated tool having a hook portion on the forward end thereof and a handle portion on the rearward end thereof. The hook portion has an upper portion extended forwardly from the handle portion and a lower portion extended downwardly and rearwardly from the upper portion to define a channel adapted to receive the opener tab and lift the same to open the can in response to lifting movement of the hook portion when a force is applied to the handle portion. The handle portion may be simply lifted upwardly to open such cans wherein the tab opener is to be lifted and separated from the can top wall. For cans wherein a scored portion of the top wall is to be depressed into the can as the tab is lifted, the opener tool of the present invention may be provided with a downwardly extended leg member adapted to depress the scored portion of the can while simultaneously serving as a fulcrum for lifting the hook portion in response to downward pivotal movement of the handle portion.

DESCRIPTION OF THE PREFERRED EMBODIMENTS

Figure 1:
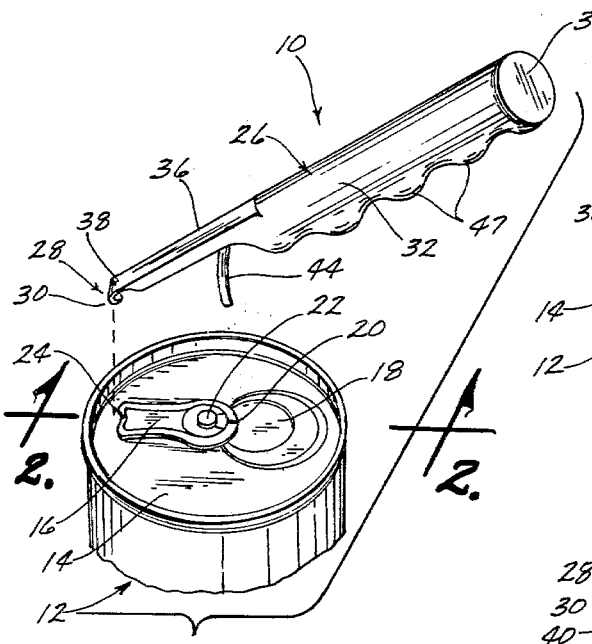
FIG. 1 is a partially fragmented perspective view of the beverage can opener of the invention which, for clarity, is shown displaced from a can provided with an opener tab.

The beverage can opener 10 of the present invention, as shown in FIG. 1, is adapted to facilitate the opening of a beverage can 12 having a top wall 14 provided with an opener tab 16 secured thereto for removing a scored section 18 and thus opening the can. These are commonly referred to as pop top cans and are commonly available in a variety of forms. In one common form, the opener tab is secured to the scored section and both are simply lifted and separated from the can to open the same. Another type of self opener is shown on the beverage can 12 of the drawings wherein the opener tab 16 is secured at one end 20 to the top wall 14 by a rivet 22 or the like with the other end simply overlying the top wall and adapted to be lifted for pivoting the scored section 18 downwardly into the can. The opener apparatus 10 of the present invention is adapted to facilitate the use of all types of pop top openers.

Figure 2:
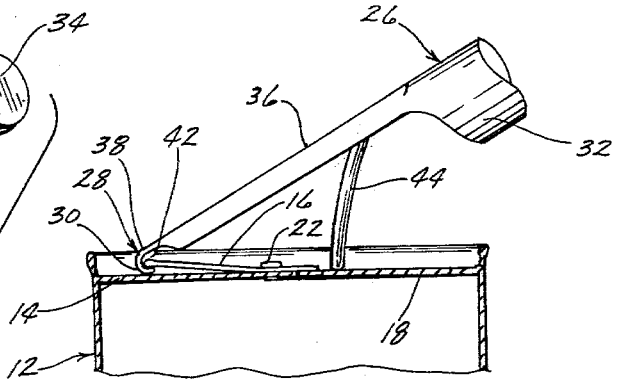
FIG. 2 is an enlarged partially sectional transverse view of the beverage can opener and can as seen on line 2—2 in FIG. 1.
Figure 4:
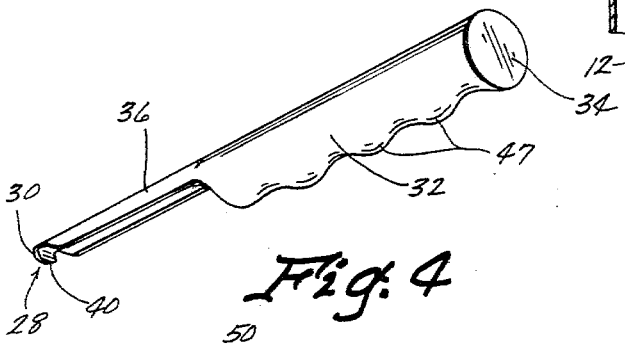
FIG. 4 is a perspective view of the beverage can opener showing the underside thereof.

Referring to FIGS. 1 and 4, the beverage can opener comprises an elongated tool 26 having a hook portion 28 at the forward end 30 thereof and a handle portion 32 at the rearward end 34 thereof. A support arm 36 which is shown as integrally formed with the handle portion 32, extends forwardly therefrom to longitudinally space the hook portion from the handle portion for a purpose to be described. The hook portion 28 has a forwardly extended upper portion 38 and a lower portion 40 extended downwardly and rearwardly from the upper portion to define a tab receiving channel 42. As seen in FIG. 2, channel 42 opens downwardly and rearwardly for easily engaging and receiving the other end 24 of opener tab 16 when the tool is positioned generally parallel to the opener tab and extended upwardly and rearwardly therefrom as shown. Note that the hook portion 28 is transversely extended so as to engage the opener tab 16 along a substantial portion of the other end 24 thereof. The transverse extent of the hook portion both facilitates the gripping of the tab as well as the application of lifting force to the tab without deforming the same.

Figure 3:
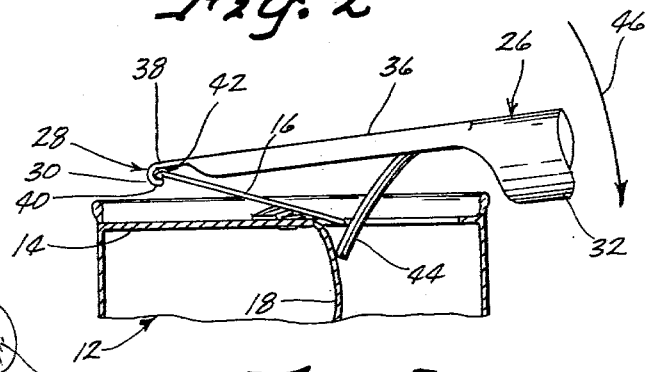
FIG. 3 is a partially sectional transverse view, similar to FIG. 2, showing the operation of the beverage can opener.

A leg member 44 is shown in FIGS. 2 and 3 as extending downwardly from the tool 26 at a position longitudinally spaced from the hook portion 28 so that its free end engages the scored section 18 when the hook portion 28 engages the opener tab 16 as shown in FIG. 2. It can be seen that the leg member 44 extends downwardly and forwardly from the tool so as to be situated substantially upright when the tool is initially positioned for opening a can. This is advantageous for the operation of the tool 26 because the leg member 44 operates both to depress the scored section 18 into the can 12 and to provide a fulcrum for lifting the hook portion 28 when a downward force is placed on the handle portion 32 to cause a pivotal movement of the tool as indicated by arrow 46 in FIG. 3. In this embodiment, the operator need only bear down on the handle portion 32 to easily open the can. The downward force on the handle portion 32 is distributed throughout the entire engagement surface between the operator's hand and handle portion 32, thereby producing only minimum stress. The same comfortable distribution of forces is applicable to the use of the tool 26 with other types of pop top cans which require the handle to be lifted away from the can. For this purpose, the handle portion 32 may be advantageously shaped as a generally cylindrical member having finger grip protrusions 47 on the underside thereof.

Figure 5:
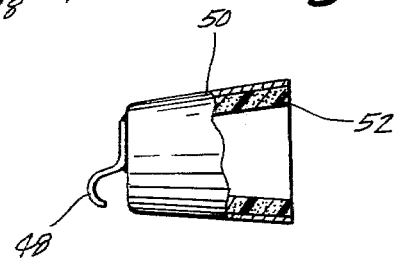
FIG. 5 is an enlarged partially sectional detail view of the forward end of an alternate embodiment of the invention.

Referring to FIG. 5, an alternate embodiment of the invention is shown wherein a simple hook member 48 is directly connected to the forward end of an elongated handle member 50. In this embodiment, however, handle member 50 comprises a thimble-like structure adapted to be fitted onto the end of one's finger for protecting the finger while enabling a can to be otherwise opened by a substantially conventional finger movement. The handle member 50 may be provided with a resilient lining 52 to assure a nonslip engagement on the operator's finger.

It will be apparent that many modifications, variations and alterations may be made within the intended broad scope of the invention as defined in the appended claims. For example, whereas handle portion 32 is disposed parallel to the support arm 36 and substantially perpendicular to the axis of the hook portion channel 42, the handle portion alternately could be disposed perpendicular to support arm 36 and parallel to the axis of channel 42, or at any other angle as desired. Thus there has been shown and described a beverage can opener which accomplishes at least all of the stated objects.

I claim:

1. An apparatus for opening a beverage can having a top wall with a scored section and an opener tab secured adjacent one end to said top wall with the other end thereof overlying said top wall for opening the can by depressing said scored section into said can in response to lifting of said other end of the tab, comprising, a tool having spaced apart forward and rearward ends with a longitudinal axis, said tool including a hook portion at the forward end thereof, a handle portion at the rearward end thereof, and a leg member extended downwardly and forwardly from said tool;

said leg member extending downwardly and forwardly from said tool in longitudinally spaced relation forward of said handle portion and rearward of said hook portion for simultaneously depressing said scored section into the can and providing a fulcrum for lifting movement of said hook portion in response to downward movement of said handle portion;

said hook portion including an upper portion connected to and extended forwardly from said handle portion and a lower portion extended downwardly and rearwardly from said upper portion to define a channel whose axis is perpendicular to said longitudinal axis adapted to receive the other end of the tab for lifting the other end of the tab and opening the can in response to lifting movement of said hook portion when a downward force is applied to said handle portion.

2. The apparatus of claim 1 wherein said hook portion is transversely extended at least sufficiently to receive a substantial portion of said other end of the tab.

3. The apparatus of claim 1 wherein said handle portion extends rearwardly from said hook portion generally perpendicularly to the axis of said channel.

4. The apparatus of claim 3 wherein said handle portion includes a generally cylindrical member having finger grip protrusions on the underside thereof.

* * * * *